US011284700B2

(12) United States Patent
Omizo et al.

(10) Patent No.: US 11,284,700 B2
(45) Date of Patent: Mar. 29, 2022

(54) BITE VALVE RETAINER

(71) Applicant: TSI Manufacturing LLC, Bend, OR (US)

(72) Inventors: Russ Omizo, Bend, OR (US); Matthew Hoskins, Bend, OR (US)

(73) Assignee: TSI Manufacturing, LLC, Bend, OR (US)

( * ) Notice: Subject to any disclaimer, the term of this patent is extended or adjusted under 35 U.S.C. 154(b) by 33 days.

(21) Appl. No.: 16/700,859

(22) Filed: Dec. 2, 2019

(65) Prior Publication Data

US 2021/0161279 A1 Jun. 3, 2021

(51) Int. Cl.
*A45F 3/16* (2006.01)

(52) U.S. Cl.
CPC ..... *A45F 3/16* (2013.01); *A45F 2003/166* (2013.01)

(58) Field of Classification Search
CPC ..... A45F 2003/045; A45F 3/00; A45F 5/02; A45F 3/04; A45F 3/20; A45F 3/16; A45F 2003/166; A45C 13/1069; A47G 21/185; A47G 21/186; A41F 1/002; Y10T 24/32
USPC ..... 224/647–649, 623, 677, 185, 175, 183, 224/148.2; 24/303; 222/175
See application file for complete search history.

(56) References Cited

U.S. PATENT DOCUMENTS

2007/0181616 A9* 8/2007 Horito ..... A45F 3/20 224/148.2
2010/0170065 A1* 7/2010 Paik ..... A44B 11/04 24/163 R
2016/0258542 A1* 9/2016 Hoskins ..... F16K 7/068
2018/0279736 A1* 10/2018 Paik ..... A44B 11/006

* cited by examiner

*Primary Examiner* — Nathan J Newhouse
*Assistant Examiner* — Matthew T Theis
(74) *Attorney, Agent, or Firm* — Klarquist Sparkman LLP

(57) ABSTRACT

A bite valve retention system can comprise a base comprising a pivot portion and one or more side portions, wherein the one or more side portions are configured to receive a portion of a strap; and a retention element comprising a first portion and a second portion, wherein the first portion is pivotably coupled to the pivot portion of the base such that the retention element pivots around an axis perpendicular to the pivot portion, and the second portion comprises a first coupling mechanism and extends from the first portion along an outer surface of the base; wherein the first coupling mechanism is configured to allow the retention element to couple and decouple from a second coupling mechanism disposed on an outer surface of a bite valve.

20 Claims, 7 Drawing Sheets

BITE VALVE RETAINER

FIELD

This disclosure relates to portable hydration systems.

INCORPORATION BY REFERENCE

A related application concerning bite valve retainers and related technology is U.S. Patent Publication No. 2007/0181616, which is incorporated by reference herein in its entirety

BACKGROUND

Hydration packs are used to provide both convenient and efficient access to drinking fluid during a wide range of physical activities. Specifically, conventional hydration packs include a tube and bite valve to deliver water from a portable reservoir to the user for easy access. However, many hydration packs fail to provide the level of accessibility needed for more strenuous activities while at the same time adequately retaining the bite valve and tube during those activities.

SUMMARY

According to representative examples, a bite valve retention system includes a base comprising a pivot portion and one or more side portions, wherein the one or more side portions are configured to receive a portion of a strap. A retention element comprising a first portion and a second portion, wherein the first portion is pivotably coupled to the pivot portion of the base such that the retention element pivots around an axis perpendicular to the pivot portion, and the second portion comprises a first coupling mechanism and extends from the first portion along an outer surface of the base. The first coupling mechanism is configured to allow the retention element to couple and decouple from a second coupling mechanism disposed on an outer surface of a bite valve.

In other examples, the first coupling mechanism and the second coupling mechanism are magnets configured to couple and decouple from one another. In some examples, the retention element is made of a flexible material. In further examples the first portion of the retention element pivotably coupled to the pivot portion allows the retention element to pivot 360 degrees around the axis perpendicular to the pivot portion.

According to another representative example, a hydration system includes a pack comprising one or more straps and configured to retain a fluid reservoir coupled to a hydration tube extending along a portion of an outside surface of the pack, wherein the fluid reservoir and the hydration tube are configured to deliver fluid from the reservoir to an opening of the hydration tube. The hydration system can also include a bite valve comprising an inlet portion, an outlet portion, and a first coupling mechanism, wherein the inlet portion is coupled to the opening of the hydration tube and configured to allow fluid flow to enter from the opening of the hydration tube and direct the fluid flow to the outlet portion of the bite valve, the outlet portion having a first configuration inhibiting fluid flow and a second configuration allowing fluid flow therethrough, wherein the first coupling mechanism is disposed on an outer surface of the bite valve.

Additionally, the hydration system can include a retention base comprising a pivot portion and one or more side portions, wherein the one or more side portions are configured to receive a portion of the one or more straps of the pack; and a retention element comprising a first portion and a second portion, wherein the first portion is pivotably coupled to the pivot portion of the retention base such that the retention element pivots around an axis perpendicular to the pivot portion, wherein the second portion comprises a second coupling mechanism and extends from the first portion along an outer surface of the base. The first coupling mechanism and the second coupling mechanism allow the bite valve to be coupled and decoupled from the retention element.

In other examples, the one or more side portions comprise at least two side portions opposite one another, each of the at least two side portions comprising a first void and a second void, wherein the first void extends between an outer edge of the retention base and the second void, and has a width and a length to receive and direct one of the one or more straps of the pack to the second void. In further examples, the outlet portion comprises a push button having a first position and a second position, wherein the first position is the outlet portion in the first configuration and the second position is the outlet portion is in the second configuration.

The foregoing and other objects, features, and advantages of the disclosed technology will become more apparent from the following detailed description, which proceeds with reference to the accompanying figures.

DETAILED DESCRIPTION

Hydration packs are used for a variety of activities, especially those more strenuous activities that require the user to stay actively hydrated, such as running, paddling, biking, and hiking. Generally, hydration packs consist of a bladder, tube, and bite valve combination configured to deliver water from the bladder through the tube and to the bite valve, and ultimately, to the user. However, the tube and bite valve are often left hanging over the user's shoulder, allowing the tube and the bite valve to move about during physical activity. When the tube and bite valve are unsecure on the user's shoulder in this way, the tube and bite valve can, among other things, cause interference with the user's movement and/or become a frustrating and unnecessary distraction to the user.

Current accessories designed to help secure the bite valve and tube during user activity typically require them to be retained within a recess or clasp, resulting in the diversion of user's time and attention in order to access and secure the bite valve and tube. In addition, some of these accessories fail to adequately secure the bite valve and/or tube during physical activities because of the forces, such as tension caused by the movement of the user, pulling on the tube. These forces result in the tube and bite valve being pulled away from the accessory, ultimately leaving the tube and bite valve once again free to move about the user's shoulder. Thus, a retention device which allows for quick and easy access to the bite valve and tube while also counteracting the forces pulling on these components is desperately needed.

Figure 1:
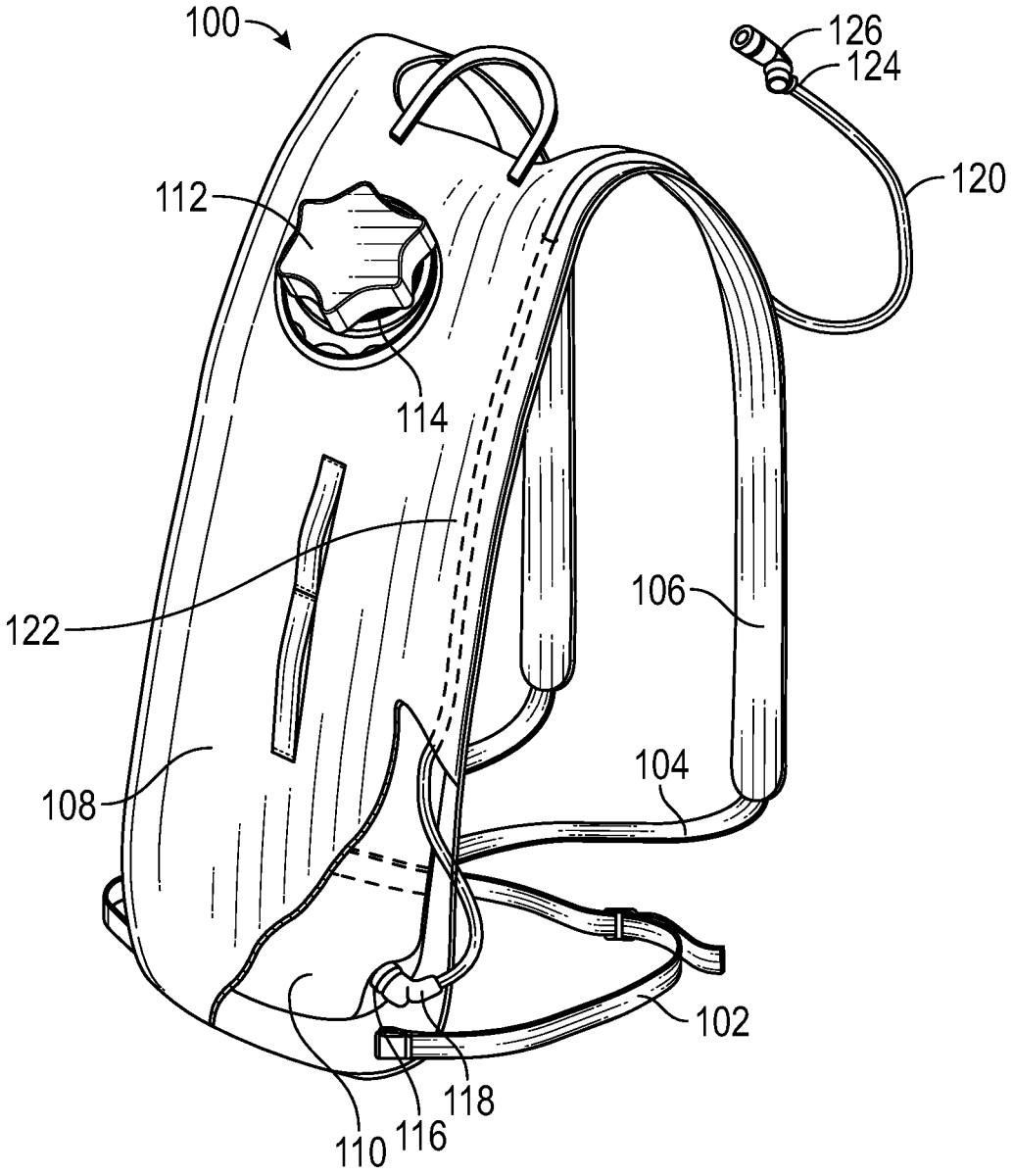
FIG. 1 is a perspective view of a hydration pack.

FIG. 1 shows that a hydration pack 100 can have one or more cross straps 102 and/or one or more shoulder straps 104 extending across a portion of the hydration pack 100 to allow the hydration pack 100 to be carried by a user. Both the cross-straps 102 and shoulder straps 104 can include a padded portion 106 which run along a portion of the straps 102, 104 for additional user comfort. The hydration pack 100 can also include a compartment 108 structured to retain a fluid reservoir 110, as shown in the cross-sectional portion of FIG. 1. The reservoir 110 can include a cap 112 and an opening 114 to allow access to the internal portion of the reservoir 110, for example, to fill the reservoir 110 with a desired fluid. Additionally, the reservoir 110 can also include an outlet 116 which can be connected to a proximal end 118 of a hydration tube 120. The hydration tube 120 can extend from the proximal end 118 through and/or along a pathway 122 (e.g. an internal or external pathway) running along a portion of the hydration pack 100 to a distal end opening 124 connected to a bite valve 126. This configuration allows the fluid contained within the reservoir 110 to be delivered through the hydration tube 120 and over the body of the user where the fluid exits the bite valve 126. The hydration tube 110 can be configured to connect and disconnect from the outlet 116 and bite valve 126, and can be made a flexible material, for example, a medical grade poly tubing.

Figure 2:
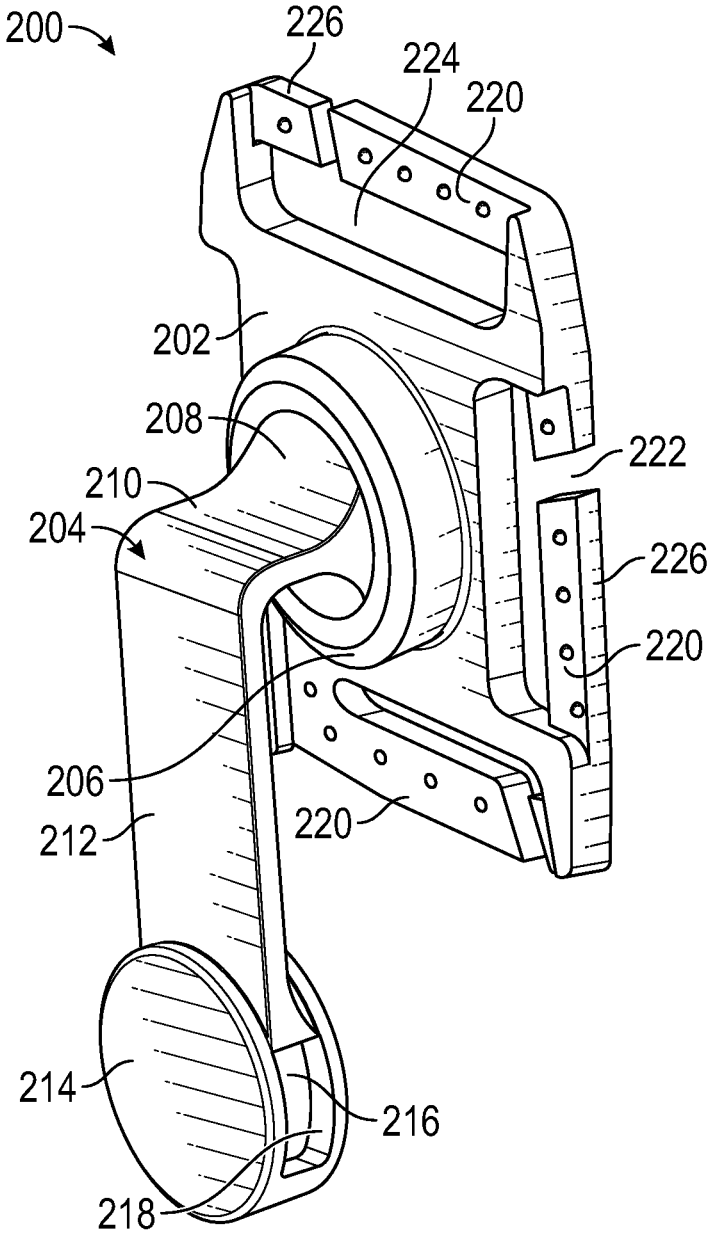
FIG. 2 is a perspective view of the bite valve retainer.

FIG. 2 shows a perspective view of a bite vale retainer 200 having a base 202 and retention element 204. The base 202 can include a pivot portion 206 having a circular structure configured to receive a circular end portion 208 of a first portion 210 of the retention element 204, such that the circular end portion 208 is pivotably coupled to the pivot portion 206. As shown in FIG. 2, the first portion 210 of the retention element 204 can extend perpendicular from the pivot portion 206 to a second portion 212 of the retention element 204 which extends along and beyond the surface of the base 202.

As shown in FIG. 2, the second portion 212 of the retention element 204 can include a coupling mechanism 214 to couple and decouple with another like and/or compatible coupling mechanism. For example, the coupling mechanism 214 can include a magnet 216 within the body of the second portion 212. The magnet 216 can be any one and/or combination of magnets, including neodymium, samarium cobalt, ceramic, alnico, or any other permanent and/or temporary magnet of any width, shape, and/or size. Advantageously, the coupling mechanism 214 facilitates quick and easy coupling and decoupling to another like mechanism. Additionally, the retention element 204 can be made of a flexible material, such as a silicon rubber and/or any elastomer material, and can include an opening 218 within the material to allow the magnet 216 to be easily added in manufacturing and/or changed if for any reason the magnetic properties become inadequate to facilitate coupling.

Furthermore, the base 202 can also include one or more side portions 220 having a first void 222 to receive and direct material into a second void 224 in order to secure the base 202 to the hydration pack 100. Where the first void 222 extends between the second void 224 and an outer edge 226 of the base 202.

Figure 3:
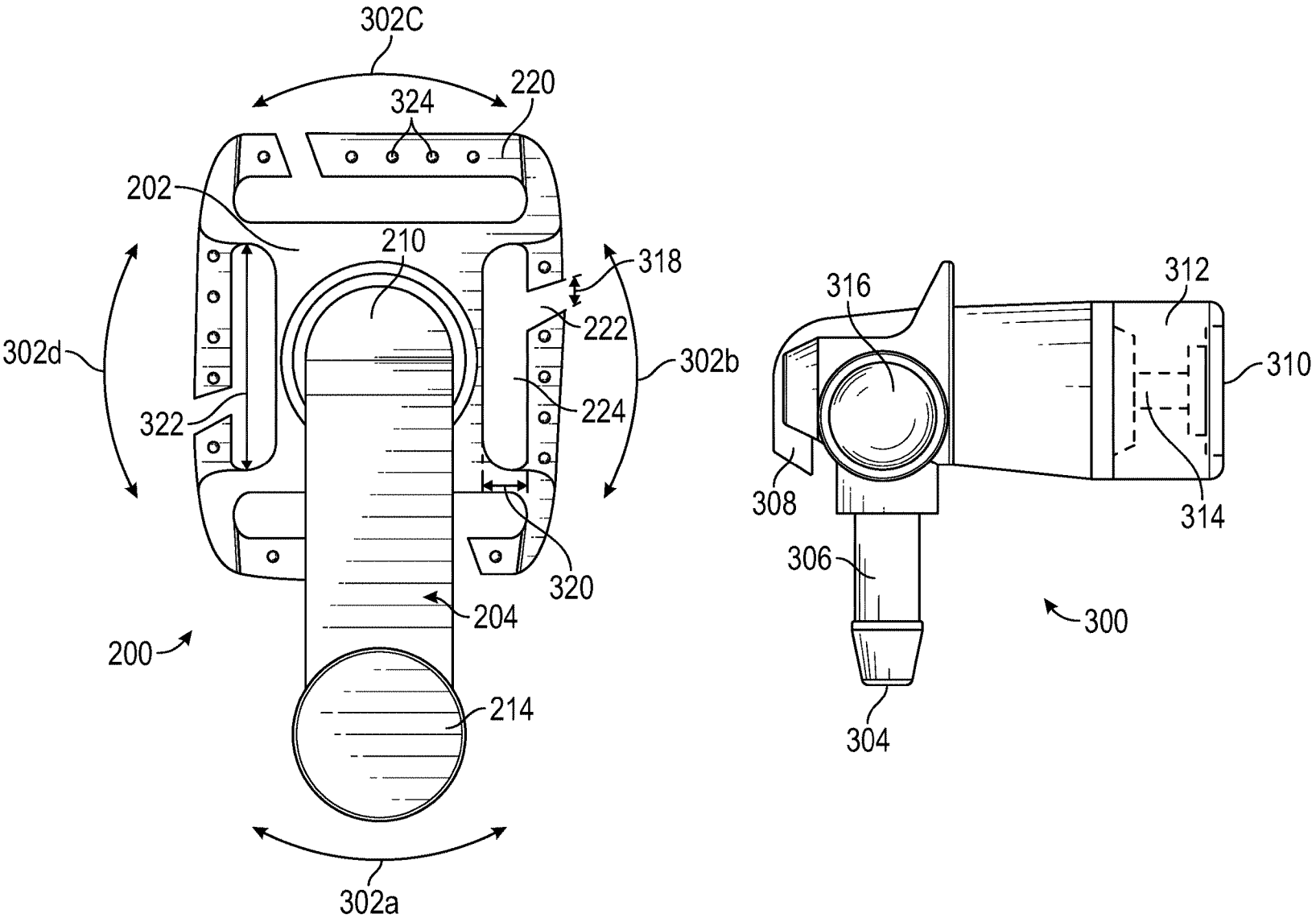
FIG. 3 is a front view of the of the bite valve retainer and a side view of the bite valve.

FIG. 3 shows a front view and the possible range of motion of the retention element 204 of the bite valve retainer 200. Arrows 302*a*, 302*b*, 302*c*, and 302*d* exhibit that the retention element 204 and coupling mechanism 214 can pivot around an axis perpendicular to the base 202 and parallel to a longitudinal axis of the first portion 210. In other words, the retention element 204 can pivot between 0° and 360° (e.g. in either the left and right directions) around an axis directed into and out of the plane of the FIG. 3. This range of motion allows the retention element 204 to pivot between 0° and 360° around the pivot portion 206 in response to movement of the user. Additionally, as mentioned above, because the retention element 204 can be made of a flexible material, the retention element 204 can thus flexibly move inward and outward (i.e. similarly in and out of the plane of FIG. 3).

FIG. 3 also shows a representative bite valve 300. The bite valve 300 can include an inlet 304, a stem 306, a valve lever 308 (or a push button), and an outlet portion 310. The inlet 304 and stem 306 of the bite valve 300 can be shaped and sized as to allow the hydration tube 120 to slide over a length of the stem 306 in order secure both the stem 306 and inlet 304 within a portion of the lumen of the hydration tube 120. The inlet 304 of the bite valve 300 is configured to allow fluid to enter and through the main body of the bite valve 300 to the outlet portion 310. The outlet portion 310 can include a mouthpiece 312 which can serve as a self-sealing cover for a spout 314. The outlet portion 310 can have a first and second configuration to both inhibit and allow fluid flow to pass therethrough, for example, to the user's mouth. The mouthpiece 312 can either be used in conjunction with the valve lever 308 (or push button), which can open and close fluid flow to the spout 314, or without the valve lever 308 such that the mouthpiece 312 acts as an open and close mechanism by way of being self-sealing around the spout 314.

Figure 4:
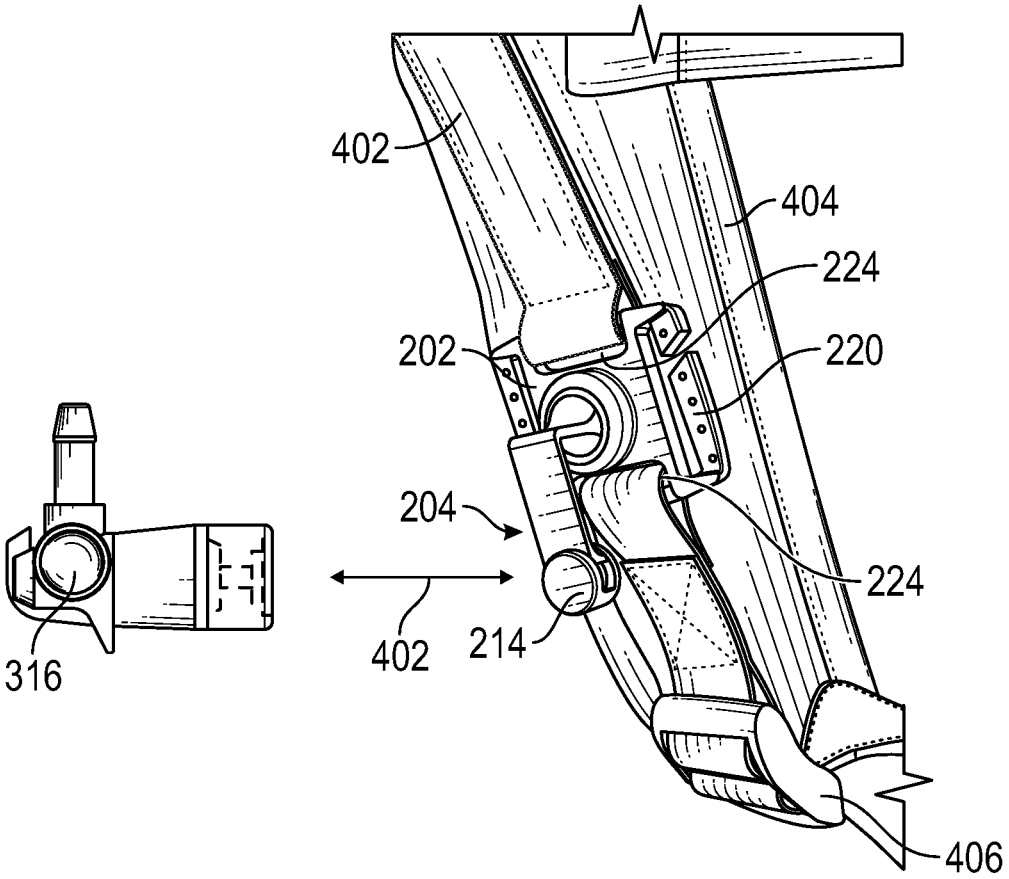
FIG. 4 is a perspective view of the bite valve retainer, bite valve, and a portion of the hydration pack

The bite valve 300 can also include a coupling mechanism 316 which is configured to allow coupling and decoupling with the coupling mechanism 214 of the retention element 204. For example, the coupling mechanism 316 can be a magnet such as those magnets compatible with the magnet 216 of the retention element 204, as discussed with regard to FIG. 2. FIG. 4 is representative of the bite valve 300 having the coupling mechanism 316 and being coupled and decoupled from the coupling mechanism 214 of the retention element 204, as indicated by the arrow 402.

Additionally, the coupling mechanism 316 of the bite valve 300 can be integrated within and/or disposed on a side surface (such as in FIG. 3) and/or in a position at or proximate to the location of the lever valve 308. It may be advantageous to optimize the attraction between the coupling mechanisms 214, 316 in a way as to optimize the benefits of the bite valve retainer 200 described herein.

FIG. 3 also shows that the first void 222 of the side portions 220 can have a minimum width 318 sufficient to allow a material to slide through and along its length. For example, the material of the cross straps 102 and/or shoulder straps 104 illustrated in FIG. 1 can be directed into the second void 224 through the first void 222. The second void 224 can also have a minimum width 320 and length 322 in order to receive and accommodate material such as a strap. For example, the width 320 and length 322 can be sufficiently greater (or lesser) than a thickness and width of a strap, respectively, to allow the user to move the base 202 along the length of the material but also secure the base 202 in a desired position. Additionally, the side portions 220 can also include a plurality of textural elements 324 which help to create friction between the surface the base 202 and material inserted to the second void 224, as way to further secure the bite valve retainer 200 at a position desired by the user.

Additionally, FIG. 4 shows the base 202 attached to the straps 402 (e.g., shoulder straps 104 and/or cross-straps 102) of the hydration pack 100. For example, the straps 402 can be the shoulder straps 104 received by the second voids 224 of the side portions 220 as to secure the base 202, for example, against a padded portion 404 (e.g., padded portion 106 in FIG. 1). Alternatively, the base 202 can have the straps 402 already secured within the second voids 224 of the side portions 224 where the straps 402 are then received by a buckle component 406 of the hydration pack 100. The buckle component 406 and straps 402 may include complimentary parts to function as a buckle, such as the parts forming a traditional buckle, a side release buckle, a slide buckle, and/or any appropriate buckling mechanism.

Figure 5:
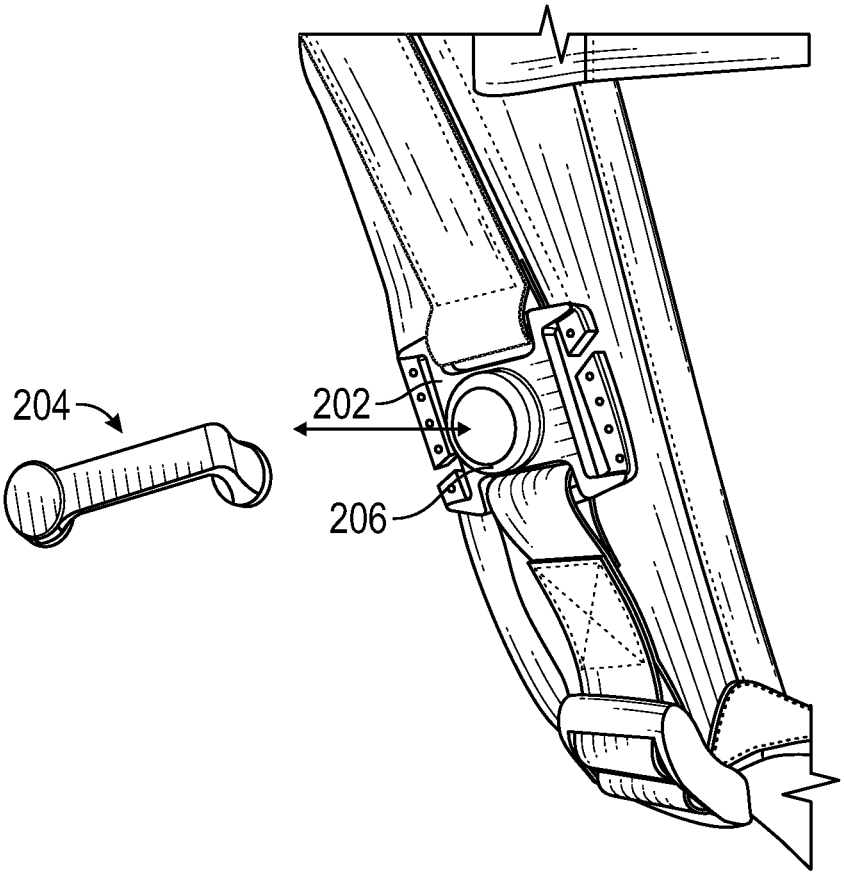
FIG. 5 is a perspective view of the bite valve retainer, retention element, and a portion of the hydration pack.

As shown in FIG. 5, the retention element 204 can be configured to couple and decouple with the base 202. The retention element 204 can be pivotably coupled to the circular pivot portion 206 of the base 202 by virtue of the structural and/or material characteristics making up the retention element 204 and pivot portion 206, such that the retention element 204 is retained and allowed to pivot between 0° and 360° as described above.

Figure 6:
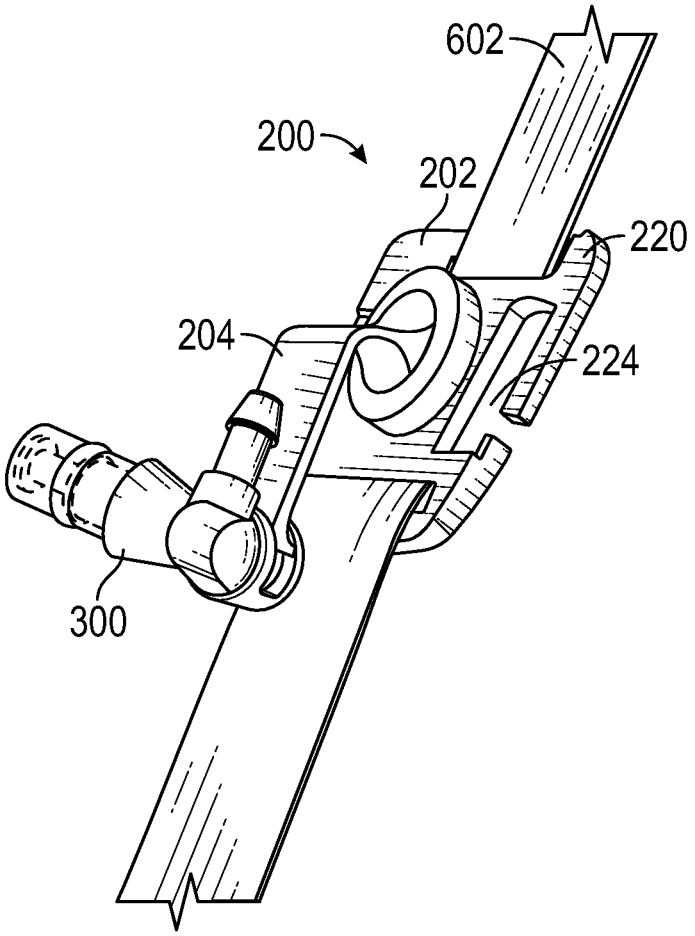
FIG. 6 is a perspective view of the bite valve coupled to the bite valve retainer and the bite valve retainer coupled to the hydration pack.

FIG. 6 shows the bite valve 300 coupled to the bite valve retainer 202 by way of the coupling mechanisms 214, 316 (hidden from view). FIG. 6 also shows a strap 602 received within the second voids 224 of the opposing side portions 220 of the base 202. Because the strap 602 extends continuously through the second voids 224 and behind the base 202, the user is able to slide the base 202 along a length of the strap in order to place the base 202 in a desired position as discussed in FIG. 3.

One of the advantages of the above described bite valve retainer 200 is that as the base 202 moves with the body movement of the user, the retention element 204 pivots side-to-side (e.g., between 0° and 360°) around the axis perpendicular to the pivot portion 206 which can counteract forces acting on the bite valve 300, for example, tension pulling on the hydration tube 120 (not shown in FIG. 6).

Figure 7:
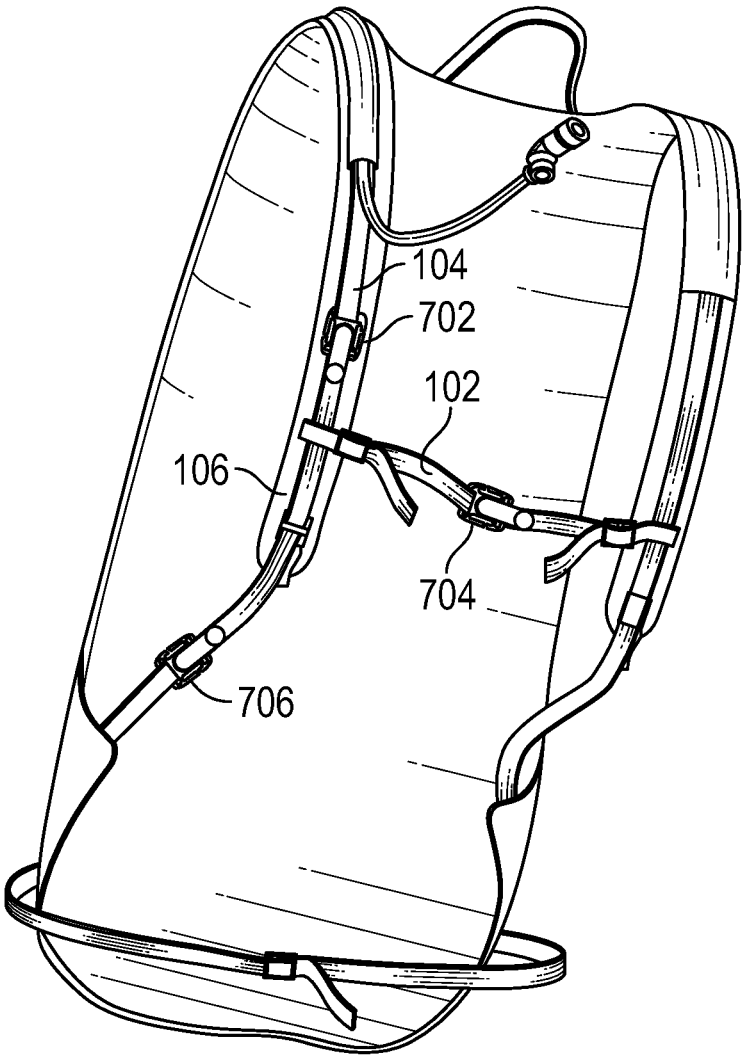
FIG. 7 is a perspective view of the bite valve retainer located at various positions on the hydration pack.

Another advantage gained from the configuration of the bite valve retainer 200 is shown in FIG. 7. Because the base 202 can receive the shoulder straps 104 and/or cross-straps 102 of the hydration pack 100 through the side portions 220, the bite valve retainer 200 is able to be positioned at various positions along the hydration pack 100. For example, the user is free to position the bite valve retainer 200 at a first position 702 along the a shoulder strap 104 (with padded portion 106), at a second position 704 along a length of the cross-straps 704 (e.g. to position the bite valve retainer at the user's chest or waist), and/or at a third position 706 along the strap 104, for example, closer to the user's side. It should be noted that these three positions are merely representative and are by no means exhaustive of the positions a user can place the bite valve retainer 200.

As used in this application and in this application and in the claims, the singular forms "a," "an," and "the" include the plural forms unless the context clearly dictates otherwise. Additionally, the term "includes" and "has" have the same meaning as "comprises." Further, the term "coupled" does not exclude the presences of intermediate elements between the coupled items.

The apparatus described herein should not be construed as limiting in any way. Instead, the present disclosure is directed toward all novel and non-obvious features and aspects of the various disclosed embodiments, alone an in various combinations and sub-combinations with one another. The disclosed apparatus is not limited to any specific aspect or feature or combinations thereof, nor does the disclosed apparatus require that any one or more specific advantages be present, or problems be solved. Any theories of operation are to facilitate explanation, but the disclosed apparatus is not limited to such theories.

In view of the many possible embodiments to which the principles of the disclosed technology may be applied, it should be recognized that the illustrated embodiments are only preferred examples of the technology and should not be taken as limiting the scope of the disclosure. Rather, the scope of the disclosure is defined by the following claims. I therefore claim all that comes within the scope and spirit of these claims.

The invention claimed is:

1. A bite valve retention system comprising:

a base comprising a pivot portion and one or more side portions, wherein the one or more side portions are configured to receive a portion of a strap; and a retention element comprising a first portion and a second portion, wherein the first portion is pivotably coupled to the pivot portion of the base such that the retention element pivots around an axis perpendicular to the pivot portion and an outer surface of the base, and the second portion comprises a first coupling mechanism and extends from the first portion along the outer surface of the base;

wherein the first coupling mechanism is configured to allow the retention element to couple to and decouple from a second coupling mechanism disposed on an outer surface of a bite valve.

2. The system of claim 1, wherein the bite valve comprises an inlet portion and an outlet portion, wherein the inlet portion is configured to allow fluid flow to enter the bite valve and direct the fluid flow to the outlet portion, the outlet portion having a first configuration inhibiting fluid flow and a second configuration allowing fluid flow therethrough.

3. The system of claim 1, wherein the first coupling mechanism and the second coupling mechanism are magnets configured to couple and decouple from one another.

4. The system of claim 1, wherein the retention element is made of a flexible material.

5. The system of claim 1, wherein the retention element is made of a silicone rubber and the first coupling mechanism is embedded within the second portion of the retention element.

6. The system of claim 1, wherein the retention element and the base are configured to couple and decouple.

7. The system of claim 1, wherein the first portion of the retention element pivotably coupled to the pivot portion allows the retention element to pivot 360 degrees around the axis perpendicular to the pivot portion.

8. The system of claim 1, wherein the one or more side portions each comprise a first void and a second void, the first void extending between an outer edge of the base and the second void, wherein the first void has a width and a length to receive and direct the strap to the second void.

9. The system of claim 1, wherein the one or more side portions comprise at least two opposing side portions.

10. The system of claim 1, wherein the one or more side portions each comprise the strap configured to couple and decouple from a pack.

11. The system of claim 1, wherein the second portion of the retention element comprises an opening and a recess configured to retain the first coupling mechanism.

12. The system of claim 1, wherein the one or more side portions comprise a plurality of textural elements.

13. A hydration system comprising:

a pack comprising one or more straps and configured to retain a fluid reservoir coupled to a hydration tube extending along a portion of an outside surface of the pack, wherein the fluid reservoir and the hydration tube are configured to deliver fluid from the reservoir to an opening of the hydration tube;

a bite valve comprising an inlet portion, an outlet portion, and a first coupling mechanism, wherein the inlet portion is coupled to the opening of the hydration tube and configured to allow fluid flow to enter from the opening of the hydration tube and direct the fluid flow to the outlet portion of the bite valve, the outlet portion having a first configuration inhibiting fluid flow and a second configuration allowing fluid flow therethrough, wherein the first coupling mechanism is disposed on an outer surface of the bite valve;

a retention base comprising a pivot portion and one or more side portions, wherein the one or more side portions are configured to receive a portion of the one or more straps of the pack; and a retention element comprising a first portion and a second portion, wherein the first portion is pivotably coupled to the pivot portion of the retention base such that the retention element pivots around an axis perpendicular to the pivot portion and an outer surface of the retention base, wherein the second portion comprises a second coupling mechanism and extends from the first portion along the outer surface of the base;

wherein the first coupling mechanism and the second coupling mechanism allow the bite valve to be coupled and decoupled from the retention element.

14. The system of claim 13, wherein the first coupling mechanism and the second coupling mechanism are magnets configured to couple and decouple from one another.

15. The system of claim 13, wherein the retention element is made of a flexible material.

16. The system of claim 13, wherein the retention element and the base are configured to couple and decouple.

17. The system of claim 13, wherein the first portion of the retention element being pivotably coupled to the pivot portion allows the retention element to pivot 360 degrees around the axis perpendicular to the pivot portion.

18. The system of claim 13, wherein the one or more side portions each comprise a first void and a second void, wherein the first void extends between an outer edge of the retention base and the second void, and has a width and a length to receive and direct one of the one or more straps of the pack to the second void.

19. The system of claim 13, wherein the one or more side portions comprise at least two side portions opposite one another, each of the at least two side portions comprising a first void and a second void, wherein the first void extends between an outer edge of the retention base and the second void, and has a width and a length to receive and direct one of the one or more straps of the pack to the second void.

20. The system of claim 13, wherein the outlet portion comprises a push button having a first position and a second position, wherein the first position is the outlet portion in the first configuration and the second position is the outlet portion is in the second configuration.

* * * * *